United States Patent [19]

Okabe

[11] 4,173,420

[45] Nov. 6, 1979

[54] PAPER FEEDING MECHANISM IN A PRINTER

[75] Inventor: Katsuhiko Okabe, Tokorozawa, Japan

[73] Assignee: Copal Company Limited, Tokyo, Japan

[21] Appl. No.: 892,269

[22] Filed: Mar. 31, 1978

[30] Foreign Application Priority Data

Apr. 5, 1977 [JP] Japan ..... 52-38691
Apr. 18, 1977 [JP] Japan ..... 52-48739[U]

[51] Int. Cl.[2] ..... B41J 15/22

[52] U.S. Cl. ..... 400/618; 400/219.4; 400/219.3; 242/57; 400/608.1; 400/636.1; 226/145; 226/155

[58] Field of Search ..... 400/617, 618, 608, 608.1, 400/636, 636.1, 219–219.4; 226/154, 155, 144, 145; 242/57

[56] References Cited

U.S. PATENT DOCUMENTS

| | | | |
|---|---|---|---|
| 2,693,235 | 11/1954 | Kenworthy et al. | 226/155 |
| 2,898,995 | 8/1959 | Funnell | 226/155 |
| 3,145,373 | 8/1964 | Willard | 226/155 |
| 3,266,612 | 8/1966 | Killel et al. | 400/636 |
| 3,292,170 | 12/1966 | D'Angelo | 242/57 |
| 3,373,682 | 3/1968 | Fisher | 226/155 |
| 3,464,612 | 9/1969 | Dalton et al. | 226/155 |
| 3,664,481 | 5/1972 | Dreimanis et al. | 400/636 |
| 3,825,200 | 7/1974 | Puhahn | 254/57 |
| 3,850,380 | 11/1974 | Kranefeld | 242/57 |
| 3,888,401 | 6/1975 | Minall et al. | 226/155 |

*Primary Examiner*—William Pieprz
*Attorney, Agent, or Firm*—Oblon, Fisher, Spivak, McClelland & Maier

[57] ABSTRACT

The paper feeding mechanism in a printer has a paper feeding roller and a pressure roller cooperating with the paper feeding roller so as to feed a paper sandwiched therebetween for the printing operation of the paper, and the pressure roller is mounted on a resiliently energized swingable lever so that the pressure roller is releasably urged against the paper feeding roller for feeding the paper. The paper feeding mechanism further comprises a paper arresting member adapted to disengageably contact with and arrest the paper when actuated, an actuating lever coupled with swingable lever as well as the paper arresting member and a driving solenoid provided with a plunger actuated thereby and coupled with the actuating lever. The relative arrangement of the swingable lever and the paper arresting member with respect to the actuating lever is so determined that, when the latter is actuated by the solenoid through the plunger thereof, the swingable lever is urged so as to move the pressure roller apart from the paper feeding roller for inactivating the feeding of the paper while the paper arresting member is actuated so as to arrest the paper.

3 Claims, 4 Drawing Figures

PAPER FEEDING MECHANISM IN A PRINTER

BACKGROUND OF THE INVENTION

The present invention relates to a paper feeding mechanism in a printer.

In a heretofore proposed printer such as a register printer, for example, a receipt paper and a journal paper are provided in juxtaposed relationship to each other and are printed simultaneously so that the printed receipt paper is delivered to a customer while the printed journal paper is wound up on a reel for the record of the printed data. In such a printer, it may be required to feed either of the receipt paper and the journal paper independently from each other. The paper feeding mechanism in such a printer comprises in general a set of a paper feeding roller and a pressure roller cooperating therewith for each of the receipt paper and the journal paper so as to feed the paper sandwiched therebetween by the action of the paper feeding roller. Thus, two sets of paper feeding mechanism are required which are actuated independently from each other, thereby rendering the construction to be very complicated.

Alternatively, a register printer may comprise a common paper feeding roller for both the receipt paper and the journal paper and a pressure roller exclusively for the receipt paper or the journal paper each normally held apart from the paper feeding roller is selectively urged against the paper feeding roller when the selected one of the papers is to be fed.

In this case, the paper located between the feeding roller and the pressure roller which is held apart from the paper feeding roller under the inactive condition of feeding of the paper is free so that it is liable to be shifted even though the pressure roller is held apart from the paper feeding roller which is rotated so as to feed the other paper by the cooperation with the pressure roller for that paper to be fed, the shifting of the paper thereby resulting in erroneous printing operation.

In a printer of the type described above, the receipt paper and the journal paper are in general supplied from respective supply rolls of paper arranged in the printer and each of the papers is selectively unwound from the roll of paper by the paper feeding mechanism belonging to that roll. Since the amount of the paper in each roll is reduced as the paper is unwound therefrom for the printing operation, it is required to provide a detecting device for preventing false printing operation due to failure of supply of paper which might be caused after the paper of the roll has been used up.

Heretofore proposed detecting device comprises a swingable detecting lever with one free end resiliently urged against the peripheral surface of the roll so as to sense the diameter or the radius of the roll which corresponds to the amount of the paper remaining in the roll, while the other free end cooperates with a switch connected to a control circuit of the printer so that the switch is actuated so as to stop the operation of the printer when the swingable lever senses the diameter or the radius reaching a predetermined value for stopping the operation of the printer in order to prevent the false printing operation. In such a prior art detecting device, the rate of reduction of the diameter or the radius of the roll is very low so that the point of actuation of the switch is rendered to be unstable and, since the switch is gradually actuated to be closed or opened, electric noise tends to be generated. Further, since the detecting lever follows the peripheral surface of the roll intermittently rotated as the paper is fed there from so that vibration of the detecting lever is caused so as to repeat the closing and opening of the switch thereby generating chattering of the switch. Further, the range of actuation of the detecting lever must be increased as the diameter of the roll is increased, thereby requiring a large detecting lever which in turn increases instability of the actuation of the switch.

The present invention aims at avoiding the above described disadvantages of the prior art paper feeding mechanism of a printer.

SUMMARY OF THE INVENTION

An object of the present invention is to provide a novel and useful paper feeding mechanism in a printer which avoids the disadvantages of the prior art paper feeding mechanism as described hereinabove.

Another object is to provide a paper feeding mechanism of the type described above which is simple in construction and accurate in operation for positively feeding a paper and for positively arresting the paper when the feeding of the paper is inactivated.

A further object is to provide a paper feeding mechanism of the type described above which is simple in construction and stable in operation for detecting the reduction of the paper wound in a roll of paper from which the paper is unwound for the printing operation by the paper feeding mechanism thereby positively preventing the false function of the printer due to failure of feeding of the paper when the paper in the roll has been used up.

The above objects are achieved in accordance with the present invention by the provision of a paper feeding mechanism in a printer which is characterized in that either one of the paper feeding roller and the pressure roller is supported on a movable lever means and urged resiliently in a direction so that the paper feeding roller and the pressure roller are disengageably urged toward each other for permitting the paper sandwiched therebetween to be fed by the action of the paper feeding roller, and the paper feeding mechanism further comprises a paper arresting means adapted to releasably contact with and arrest the paper when the paper arresting means is actuated, an actuating lever means coupled with the movable lever means as well as the paper arresting means, and driving means coupled with the actuating lever means for driving the latter when the driving means is actuated, the relative arrangement of the movable lever means and the paper arresting means with respect to the actuating lever means being so determined that, when the latter is actuated by the driving means, the movable lever means is urged so as to move either one of the paper feeding roller and the pressure roller apart from the other for inactivating the feeding of the paper by the paper feeding roller while the paper arresting means is actuated so as to contact with and arrest the paper.

According to another feature of the present invention, the movable lever means may be formed with a manually operable portion so that the movable lever means can be moved manually by manipulating that portion so as to urge either one of the paper feeding roller and the pressure roller apart from the other for inactivating the feeding of the paper by the paper feeding roller independently from the actuation of the driving means while the paper arresting means is not actuated through the actuating lever means so as to arrest the paper.

According to yet another feature of the present invention, the paper arresting member can compensate for variations in paper thickness so that relatively thick paper is not caught by the paper arresting member when the driving means is not actuated.

Further, according to a further feature of the present invention, the printer comprises a paper supply roll from which the paper is unwound and fed for the printing operation by the action of paper feeding roller, detecting lever means adapted to engage with the paper supply roll so as to sense the amount of the paper remaining in the roll and switch means cooperating with the detecting lever means so as to be actuated thereby for controlling the operation of the printer when the amount of the paper remaining in the paper supply roll reaches a predetermined amount, the detecting lever means being so arranged with respect to the paper supply roll that the sensing portion of the detecting lever means adapted to engage with the paper supply roll contacts with the side surface of the roll at a predetermined position with respect to the roll and urged against the side surface of the roll in the axial direction thereof thereby permitting the prompt actuation of the detecting lever when the diameter or the radius of the roll reaches the predetermined position as the paper is unwound from the roll so that the unstable operation of the switch means is positively avoided.

DETAILED DESCRIPTION OF THE PREFERRED EMBODIMENTS

Figure 1:
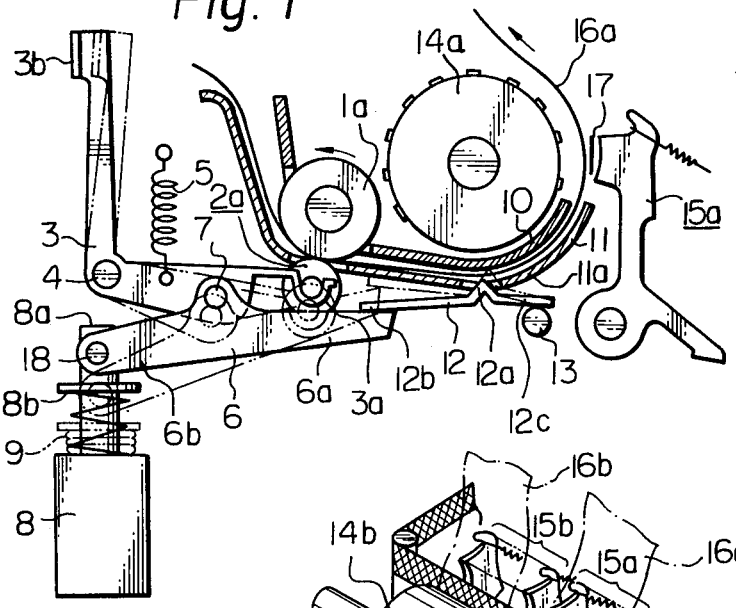
FIG. 1 is a schematic side view partly in cross-section showing an embodiment of the paper feeding mechanism according to the present invention.
Figure 2:
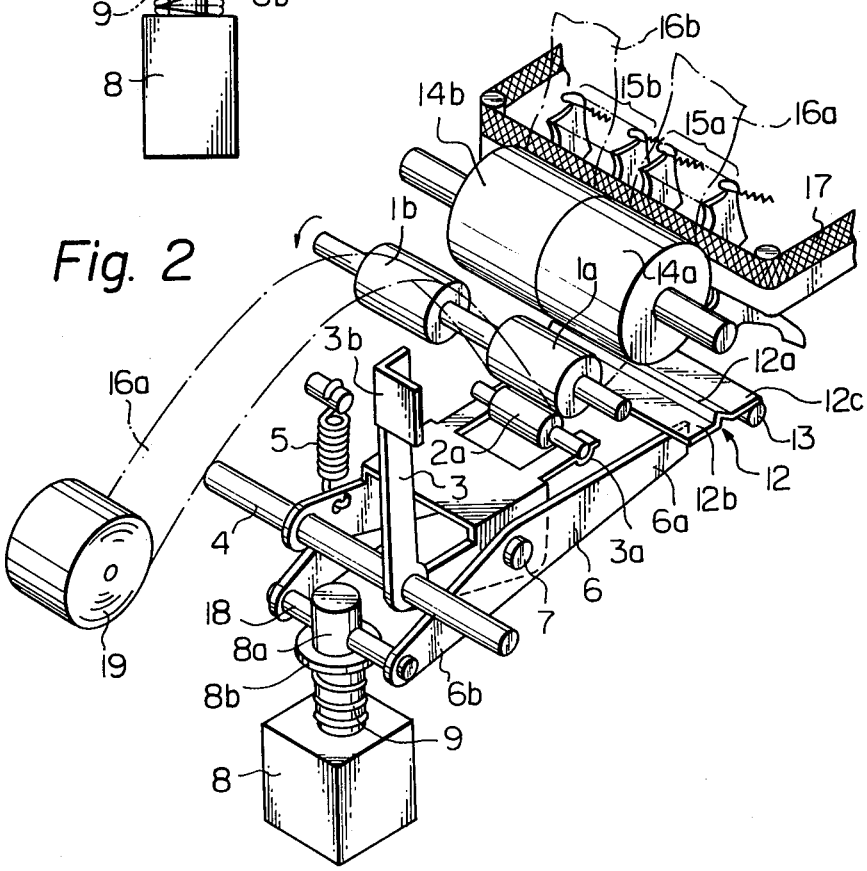
FIG. 2 is a perspective view with portions omitted for clear showing of the paper feeding mechanism shown in FIG. 1.

Referring to FIGS. 1 and 2 showing the printer in the position wherein the feeding of the papers is being effected, the printer is provided with a paper feeding roller 1*a* and a paper feeding roller 1*b* each cooperating with a pressure roller 2*a* and a pressure roller (not shown in FIG. 2 but similar to the pressure roller 2*a*), respectively. The paper feeding rollers 1*a* and 1*b* may be commonly rotated continuously during the operation of the printer or may commence rotation each time the feeding of the paper 16*a* or 16*b* is to be effected under the control of a control circuit (not shown) of the printer. The pressure roller 2*a* is rotatably mounted by a set of bearings 3*a* provided on the free end of an L-shaped swingable lever 3 swingably supported on a shaft 4 and urged in the counterclockwise direction by a spring 5 with its one end secured to the lever 3 while the other end is secured to a stationary point in the printer so that the pressure roller 2*a* is releasably urged against the paper feeding roller 1*a* for feeding a journal paper 16*a* fed out of a roll of paper 19 and passed through the nip formed between the paper feeding roller 1*a* and the pressure roller 2*a*. The journal paper 16*a*, after passed through the nip between the rollers 1*a* and 2*a*, is guided along between an inner guide plate member 10 and an outer guide plate member 11 arranged in parallel to the member 10 with an appropriate distance held therefrom as shown in FIG. 1 and fed around a printing ring assembly 14*a* so that selected set of characters on the journal paper 16*a* in cooperation with a set of printing hammers 15*a* arranged in alignment with the respective characters on the printing ring assembly 14*a* with or without interposition of a printing ribbon 17 therebetween under the control of the control circuit of the printer as is well known in the art.

In the similar way, a receipt paper 16*b* is fed out of a roll (not shown) and passed around a printing ring assembly 14*b* by the action of the paper feeding roller 1*b* so that the selected set of characters on the printing ring assembly 14*b* is printed on the receipt paper 16*b* in cooperation with the printing rings 15*b*. Since the feeding mechanism belonging to the receipt paper 16*b* is similar to that for the journal paper 16*a*, detailed illustration thereof is omitted from FIG. 2 for the clear showing of the figure and the description will be given hereinafter only to the mechanism belonging to the journal paper 16*a*, but it must be noted that the same applies to the mechanism belonging to the receipt paper 16*b*.

After the printing of the journal paper 16*a* is effected, it is wound up in a reel (not shown) for the registration of the records of the journal paper 16*a*, while the receipt paper 16*b*, after the printing thereon is effected, is severed into individual receipt forms and delivered to the customers as the receipts of the sale, for example.

Since the pressure roller 2*a* is supported on the swingable lever 3 as described above, it can be selectively moved apart from the paper feeding roller 1*a* by swinging the lever 3 in the clockwise direction against the action of the spring 5 in order to permit the receipt paper 16*b* to be selectively fed while the feeding of the journal paper 16*a* is rendered to be inoperable by virtue of the movement of the pressure roller 2*a* apart from the paper feeding roller 1*a*, or vice versa.

In this case, however, the journal paper 16*a* is free from contact with any components in the printer and tends to be shifted erroneously by the incidental or possible contact of the journal paper 16*a* with the paper feeding roller 1*a* which is commonly rotated together with the paper feeding roller 1*b* for feeding of the receipt paper 16*b*, thereby resulting in deterioration of the quality of printing on the journal paper 16*a*.

In order to positively avoid such a false feeding of the journal paper 16*a* when it is required to maintain the journal paper 16*a* stationarily, a paper arresting member 12 having an inverted V-shaped ridge portion 12*a* at its intermediate portion for the journal paper 16*a* is provided in accordance with the present invention as shown in FIGS. 1 and 2. One end edge 12*c* of the paper arresting member 12 is swingably supported on or secured to a rotatable shaft 13 so that the ridge portion 12*a* can be passed through an opening 11*a* formed in the outer guide plate member 11 so as to abut against the inner guide plate member 10 when the paper arresting member 12 is swung in the clockwise direction thereby permitting the journal paper 16*a* guided along between the guide plate members 10 and 11 to be arrested by the ridge portion 12*a*.

In order to correlate the movement of the pressure roller 2*a* for inactivating the feeding of the journal paper 16a with the actuation of the paper arresting member 12, an actuating lever 6 is provided which consists of a pair of lever portions of the same configuration. The actuating lever 6 is pivotally connected at its intermediate portion by a pivot shaft 7 to the L-shaped swingable lever 3 at a position thereof between the bearing 3a and the shaft 4, while one end 6a of the lever 6 pivotally supports thereon the other end portion 12b of the paper arresting member 12. Thus, the actuating lever 6 is swingably supported in suspended relationship on the swingable lever 3 by the pivot shaft 7.

An electrically actuatable solenoid 8 having a plunger 8a is provided, and the other end 6b of the actuating lever 6 is pivotally connected to the plunger 8a by a pivot shaft 18. The plunger 8a is normally urged upwardly by a spring 9 arranged around the plunger 8a and held between the solenoid 8 and a flange 8b secured to the plunger 8a so as to permit the swingable lever 3 to be urged by the spring 5 in the counterclockwise direction thereby urging the pressure roller 2a against the paper feeding roller 1a for feeding the journal paper 16a, while the paper arresting member 12 is held in the released position permitting the journal paper 16a to be freely fed without interference with the ridge portion 12a of the paper arresting member 12.

When it is required to inactivate the feeding of the journal paper 16a and to maintain the same stationarily, the solenoid 8 is energized under the control of the control circuit so that the plunger 8a is moved downwardly against the action of the spring 9 thereby urging the actuating lever 6 in the counterclockwise direction thus urging the swingable lever 3 in the clockwise direction against the action of the spring 5 so as to disengage the pressure roller 2a from the paper feeding roller 1a for inactivating the feeding of the journal paper 16a while the paper arresting member 12 is swung in the clockwise direction by the engagement of the end portion 12b with the end 6a of the actuating thereby positively arresting the journal paper 16a by the abutment of the ridge portion 12a against the inner guide member 10 with the paper 16a sandwiched therebetween.

The L-shaped swingable lever 3 is provied with an upstanding arm 3b forming a manually actuatable portion. Thus, when the arm 3b is manually operated to swing the lever 3 in the clockwise direction, the pressure roller 2a is disengaged from the paper feeding roller 1a for inactivating the feeding of the journal paper 16a and the same is positively arrested stationarily by the paper arresting member 12 independently from the energization of the solenoid 8 thereby permitting the manual selective inactivation of the journal paper 16a and positive arresting of the same.

The manner for feeding and arresting the journal paper 16a applied also to the manner of feeding and arresting the receipt paper 16b.

If a relatively thick portion of the paper 16a or 16b passes between rollers 1 and 2, roller 2 will be relatively moved apart from roller 1 and in the downward direction. The downward movement of roller 2 will carry downward pivot shaft 7 on swingable lever 3. Since pivot shaft 18 remains stationary when the solenoid 8 is not actuated, the downward movement of pivot shaft 7 will cause end 6a of actuating lever 6 to move downward. The end 12b of arresting member 12 also moves downward with the end 6a of the actuating lever and carries the ridge portion 12a with it so that the gap between the ridge portion 12a and the inner guide plate 10 increases to accommodate the thicker gauge paper. In this way the arresting member is able to automatically compensate for paper thickness variations.

Figure 3:
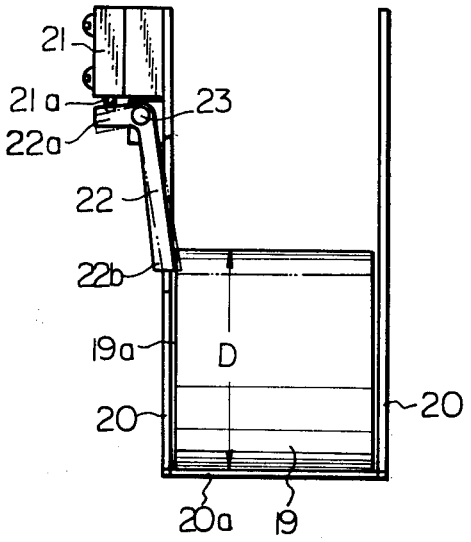
FIG. 3 is an end view showing the arrangement of the detecting lever and the switch for detecting the amount of the paper remaining in the roll of paper so as to prevent false function of the printer due to failure of feeding of the paper.

FIG. 3 shows the detecting device of the present invention for automatically stopping the operation of the printer when the supply roll of paper 19 is used up.

The supply roll 19 shown in FIG. 2 is schematically shown in FIG. 3 as being supported by the peripheral surface and the side surfaces thereof by a bottom plate 20a and side plates 20, respectively. Thus, the uppermost peripheral surface is lowered as shown when the diameter D of the roll 19 decreases as the paper is unwound from the roll 19.

In accordance with the present invention, an L-shaped detecting lever 22 is pivotally supported by a pivot shaft 23 on a bracket secured to one of the side plates 20 so that the depending arm 22b forming the sensing portion for the roll 19 is swung in the direction parallel to the axis of the roll 19 through an opening formed in that side plate 20.

The other arm 22a of the detecting lever 22 is located so as to cooperate with the actuator 21a of a switch 21 connected to the control circuit and secured to the side plate 20 so that the lever 22 is urged in the counterclockwise direction by the actuator 21a.

The tip of the sensing portion 22b is so positioned with respect to the roll 19 that the sensing portion 22b abuts against the side surface 19a of the roll 19 to position the switch 21 for the operation of the printer insofar as the diameter D of the roll 19 is large enough to supply the paper therefrom for insuring the proper printing operation, but, when the diameter D is reduced to a predetermined value which might lead to a false function of the printer by the failure of feeding of the paper, the tip of the sensing portion 22b is promptly swung across over the peripheral surface of the roll 19 thereby switching the position of the switch 21 for stopping the operation of the printer.

Since the movement of the sensing portion 22b across over the peripheral surface of the roll 19 when the diameter D is reduced to the predetermined value is effected promptly and definitely without permitting the return movement of the sensing portion 22b, the stable and definite control of the operation of the printer is positively insured in contrast to the prior art detecting device in which repetition of switching of the positions of the switch and the chattering of the switch can not be avoided leading to unstable control of the operation of the printer.

Figure 4:
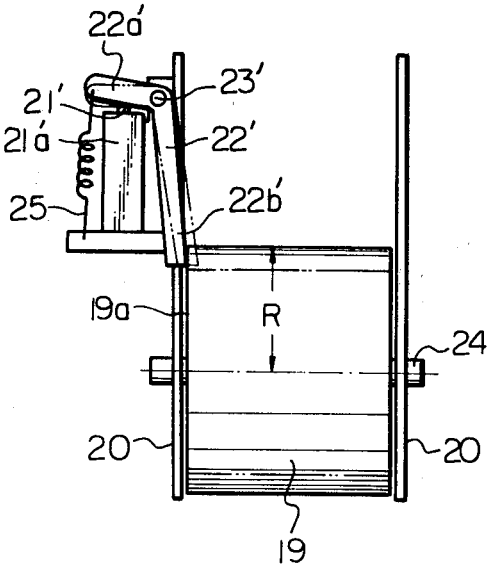
FIG. 4 is an end view similar to FIG. 3 but showing an alternative arrangement of the detecting lever and the switch with respect to the roll.

FIG. 4 shows an alternative form of the detecting device of the present invention.

In this case, the roll 19 is supported by a shaft 24 supported by the side plates 20 so that the detecting portion 22b' of the detecting lever 22' is determined to sense the reduction of the radius R of the roll 19 to a predetermined value.

The detecting lever 22' is swingably supported by a pivot shaft 23' and urged in the counterclockwise direction by a spring 25, the other arm 22a' of the detecting lever 22' cooperating with the actuator 21a' of the switch 21'. The function of the detecting device shown in FIG. 4 is similar to that shown in FIG. 3.

The detecting device of the present invention as shown in FIGS. 3 and 4 makes it possible to be used with a roll 19 regardless of the diameter thereof without increasing the size of the detecting lever.

Further, the detecting device of the present invention is free from the vibration of the roll during the feeding of the paper therefrom without permitting the repetition of the switching of the positions of the switch, thus insuring long effective life of the switch.

I claim:

1. A paper feeding mechanism in a printer having a continuously rotating feeding roller which is capable of feeding recording paper, a pressure roller cooperating with said feeding roller for feeding said recording paper sandwiched between said feeding roller and said pressure roller along a paper guide means, and a printing ring cooperating with a printing hammer for printing upon recording paper fed therebetween, said paper feeding mechanism comprising:

a swingable lever supporting at least one of said feeding roller and said pressure roller;

means for resiliently urging said one of said feeding roller and said pressure roller into disengageable engagement with the other but with said recording paper sandwiched therebetween and fed by said continuously rotating paper feeding roller;

an actuating lever pivoted to said swingable lever intermediate their ends;

a paper arresting means contacting said actuating lever at one end so as to cooperate with the operation thereof and adapted to be actuable so as to releasably contact and arrest said recording paper; and driving means to which said actuating lever is pivoted at the other end of said actuating lever, said driving means driving said actuating lever when said driving means is actuated;

wherein said swingable lever and said paper arresting means are so arranged with respect to said actuating lever that, when said actuating lever is actuated by said driving means, said swingable lever is urged to move one of said paper feeding roller and said pressure roller apart from the other, so as to inactivate the feeding of said paper by said paper feeding roller while said paper arresting means is actuated by said actuating lever to arrest said paper.

2. The paper feeding mechanism of claim 1 wherein said recording paper comprises at least two different kinds of recording paper and said pressure roller comprises one pressure roller for each kind of recording paper.

3. Paper feeding mechanism according to claim 1, wherein said movable lever means is formed with a manually operable portion so that said movable lever means can be moved manually by manipulating said portion so as to urge said either one of said paper feeding roller and said pressure roller apart from the other for inactivating the feeding of the paper by said paper feeding roller independently from the actuation of said driving means while said paper arresting means is not actuated through said actuating lever means so as to arrest the paper.

* * * * *